US006460994B1

(12) United States Patent
Nolan

(10) Patent No.: US 6,460,994 B1
(45) Date of Patent: Oct. 8, 2002

(54) PLANO-CONVEX LENS SYSTEM FOR UNDERWATER DIVING MASK

(76) Inventor: Philip Nolan, 919 Circle Ave., Forest Park, IL (US) 60130-2322

( * ) Notice: Subject to any disclaimer, the term of this patent is extended or adjusted under 35 U.S.C. 154(b) by 0 days.

(21) Appl. No.: 09/645,655

(22) Filed: Aug. 24, 2000

(51) Int. Cl.[7] ..... G02C 1/00
(52) U.S. Cl. ..... 351/43; 351/41
(58) Field of Search ..... 351/43, 41, 159; 2/426, 427, 428, 441

(56) References Cited

U.S. PATENT DOCUMENTS

| | | | | |
|---|---|---|---|---|
| 3,051,957 A | | 9/1962 | Chan | |
| 3,055,256 A | * | 9/1962 | Andresen, Jr. | 351/43 |
| 3,672,750 A | | 6/1972 | Hagen | |
| 5,359,371 A | | 10/1994 | Nolan | |
| 5,523,804 A | | 6/1996 | Nolan | |
| 5,625,425 A | | 4/1997 | Kranhouse | |
| 5,764,332 A | | 6/1998 | Kranhouse | |
| 5,777,712 A | * | 7/1998 | Sansalone | 351/43 |

FOREIGN PATENT DOCUMENTS

| | | |
|---|---|---|
| FR | 1374010 | 8/1964 |
| JP | 63-109412 | 5/1988 |

OTHER PUBLICATIONS

Press Release of HydroOptix; Jul. 16, 1999.
Optometrie Weekly vol. 52 pp. 1381–1385 Jul. 13, 1961, Mr. James R. Gregg.

* cited by examiner

*Primary Examiner*—Hung Xuan Dang
(74) *Attorney, Agent, or Firm*—Nicholas A. Kees; Godfrey & Kahn, S.C.

(57) ABSTRACT

An underwater diving mask comprising a face piece formed of suitable material so as to substantially conform to the contour of a diver's face, and a strap for releasably securing the face piece against the diver's face. The face piece has at least one opening formed in the forward part thereof for receiving a lens therein. The lens has an inner surface that is substantially flat (i.e. planar), and an outer surface that is slightly convex to thereby compensate for the magnification problem caused by the different indices of refraction between water and air. Preferably, the diopter value of the convex outer surface of the lens is between 0 and 1.0 so as to remove the lens from the domain of corrective lenses. A secondary corrective lens can, however, be affixed to the planar inner surface of the lens for those divers who would otherwise require corrective lenses. The lens is optionally treated to inhibit fogging, to reduce the amount of light reflected off the lens, to provide enhanced contrast imaging, and to protect divers from dangerous underwater radiation emissions.

23 Claims, 2 Drawing Sheets

PLANO-CONVEX LENS SYSTEM FOR UNDERWATER DIVING MASK

BACKGROUND OF THE INVENTION

The present invention relates generally to underwater diving masks, and, more particularly, to a lens system that compensates for the magnification problem caused by the different indices of refraction between water and air.

Underwater diving masks are commonly used in a variety of underwater activities, such as scuba diving, snorkeling, underwater photography and the like. Conventional diving masks generally consist of a pre-formed face piece that fits over the diver's eyes and generally also the nose, and a strap that secures the face piece against the diver's face. Some diving masks have a single large opening formed in the forward part of the face piece, and a relatively flat transparent plate is mounted in the opening to enable the diver to view the surrounding marine environment. In other diving masks, two openings are formed in a side-by-side relationship in the forward part of the face piece (i.e. one for each eye of the diver), and a flat transparent plate is mounted in each opening.

While conventional diving masks serve the basic function of keeping water away from the diver's eyes, they have a number of disadvantages which are well known in the art. Most notably, because marine light is bent as it passes through the flat plate due to the different indices of refraction between water and air, objects viewed on an axis perpendicular to the plate appear approximately 33% larger and 25% closer than they actually are. The magnification of objects viewed off-axis is even larger. As a result, small objects in the water can be magnified out of proportion to their size, which can cloud the visual field. In addition, the diver's peripheral vision is severely compromised, resulting in what is commonly referred to as "tunnel vision."

The magnification problem associated with conventional diving masks has been addressed in the past by the use of complex lens systems. For example, U.S. Pat. No. 3,672,750 to Hagen discloses an underwater diving mask wherein a diver is required to look through several layers of material that have a refractive boundary between them. Another example is the underwater diving mask disclosed in U.S. Pat. Nos. 5,764,332 and 5,625,425 to Kranhouse, wherein the spherical centers of two hemispherically-shaped lenses are designed to coincide with the optical nodal points of the diver's eyes. While these diving masks purportedly compensate for the foreshortening effect of the water, their complex designs make them relatively difficult and expensive to manufacture. A further problem associated with the Kranhouse diving mask is the relatively large size (and thus weight) of the lenses, which makes the mask impractical for use by dry-suit divers who generally require lenses formed of tempered glass.

Another attempt to compensate for the different indices of refraction between water and air is shown in U.S. Pat. Nos. 5,359,371 and 5,523,804 to Nolan, the applicant of the present application. In these patents, an underwater diving mask is disclosed which includes a lens having a flat inner surface facing toward the diver's face and a concave outer surface facing away from the diver's face. Because the outer surface of the lens is concave (as opposed to flat), marine light intersects the lens normally and is transmitted therethrough without deviation.

In addition to the above-noted magnification problem, there are other disadvantages associated with conventional diving masks. For example, the air chamber between the support plate and the diver's face can easily fog up when the diver exhales through his or her nose. Another problem is that approximately 11% of marine light is reflected off the support plate, resulting in a visual field that appears dim to the eyes of the diver. Also, the diver's vision is compromised due to the fact that red and yellow hues are rapidly absorbed at 1–1.5 atmospheres. In addition, certain commercial and military activities (e.g. underwater gas and arc welding operations) can place divers at risk to radiation emissions that can pass through the support plate and have a deleterious effect on the nonregenerative ocular tissue of the divers'eyes.

Therefore, in view of the problems associated with the above-described diving masks, it is an object of the present invention to provide a diving mask having a lens system that 1) is designed to compensate for the different indices of refraction between water and air, 2) has a simple design that it is relatively easy and inexpensive to manufacture, 3) inhibits fogging, 4) reduces the amount of marine light reflected off the lens, 5) provides uncompromised vision, and 6) protects divers from the harmful effects of underwater radiation emissions.

SUMMARY OF THE INVENTION

These and other objectives are met by the plano-convex lens system for the underwater diving mask of the present invention. This diving mask generally consists of a face piece formed of suitable material so as to substantially conform to the contour of a diver's face, and a strap for releasably securing the face piece against the diver's face. The face piece has at least one opening formed in the forward part thereof for receiving a lens therein. The inner surface of the lens facing toward the diver's face is substantially flat (i.e. planar), and the outer surface of the lens facing away from the diver's face is slightly convex.

Preferably, the diopter value of the outer surface of the lens is between 0 and 1.0, and is most preferably between 0 and 0.5. These diopter values are sufficient to compensate for the magnification problem caused by the different indices of refraction between water and air, while remaining well out of range of the diopter values used for corrective vision. A secondary corrective lens can, however, be affixed to the flat inner surface of the lens for those divers who would otherwise require corrective lenses.

In one embodiment, the diving mask has a single large opening formed in the forward part of the face piece, and a large plano-convex lens is mounted within the opening to provide a closure therefor. In another embodiment, the diving mask has a single large opening formed in the forward part of the face piece, and a large transparent support plate is mounted within the opening to provide a closure therefor. The support plate itself is substantially flat on both sides, with the exception of a pair of plano-convex lenses integrally formed in a side-by-side relationship within the plate (i.e. a lens for each eye of the diver). In yet another embodiment, two openings are formed in a side-by-side relationship in the forward part of the face piece (i.e. an opening for each eye of the diver), and a plano-convex lens is mounted within each opening to provide a closure therefor.

The underwater diving mask of the present invention is also preferably designed to overcome other problems associated with conventional diving masks. For example, anti-fogging means may be applied to the inner surfaces of the plano-convex lenses to inhibit fogging. Also, an anti-reflectant coating may be applied to the plano-convex lenses for boosting the light transmission from 89% to 99.2%. In addition, to provide enhanced contrast imaging and/or protect the diver from ionizing and non-ionizing radiation emissions associated with dangerous underwater work (such as gas and arc welding operations), the plano-convex lenses may be treated or coated with a coloring agent to inhibit the passage therethrough of certain wavelengths of light. The plano-convex lenses may be polarized for this same purpose.

The present invention will be better understood from the following detailed description of the invention, read in connection with the drawings as hereinafter described.

DESCRIPTION OF THE PREFERRED EMBODIMENTS

The present invention is directed to an underwater diving mask having a plano-convex lens system that is designed to compensate for the different indices of refraction between water and air. While the invention will be described hereinbelow with regard to specific embodiments, it should be understood that various design modifications could be made to these embodiments without departing from the scope of the present invention.

Figure 1:
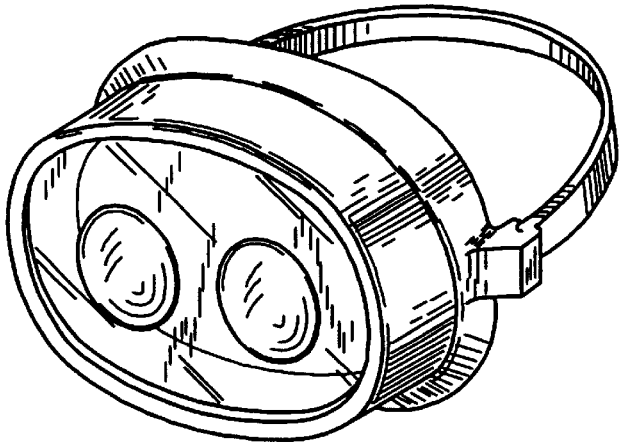
FIG. 1 is an isometric view of a first embodiment of the underwater diving mask of the present invention.
Figure 2:
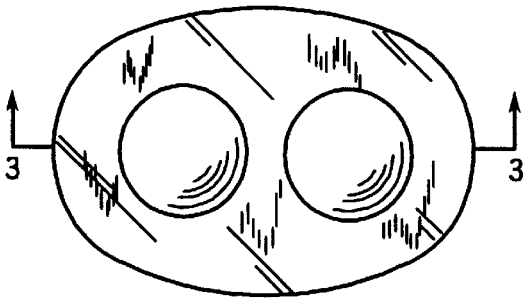
FIG. 2 is a front elevational view of the support plate of the underwater diving mask shown in FIG.1.
Figure 3:
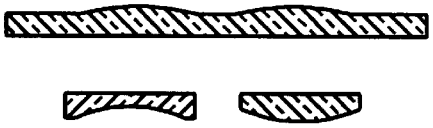
FIG. 3 is a cross-sectional view of the support plate shown in FIG. 2, taken generally along line 3—3, shown with a pair of corrective lenses disassembled therefrom.

Referring now to FIGS. 1–3, an underwater diving mask 10 constructed according to a first embodiment of the present invention includes a conventional face piece 12 that is configured to fit over the eyes and nose of a diver. Face piece 12 has a back portion 14 formed of a relatively soft material that substantially conforms to the contour of a diver's face. Mask 10 also includes a strap 16 for securing face piece 12 against the diver's face. The ends of strap 16 are connected to back portion 14 of face piece 12 by appropriate attachment means 18, as is known in the art. The material of strap 16 is normally elastic in nature so that back portion 14 of face piece 12 snugly fits against the diver's face to thereby seal out water. The length of strap 16 is preferably adjustable for the same purpose. Of course, it should be understood that any means of releasably securing face piece 12 against the diver's face could be used.

Looking still to FIG. 1, it can be seen that a large opening 20 is formed in the forward part of face piece 12. Mounted within opening 20 is a large support plate 22 that completely closes opening 20 such that water cannot leak into the air chamber between face piece 12 and the diver's face. While opening 20 and support plate 22 are illustrated as having a rounded or elliptical shape, it should be understood that any shape suitable for use in or adaptation to a conventional diving mask could be used. In addition, those skilled in the art will appreciate that support plate 22 could alternatively be mounted within an opening formed in the forward part of a diving helmet (not shown).

Turning to FIGS. 2 and 3, support plate 22 is shown in greater detail. As best shown in FIG. 3, support plate 22 is substantially flat on both sides, with the exception of two lenses 24*a* and 24*b* which in this embodiment are integrally formed in a side-by-side relationship within support plate 22 (i.e. a lens for each eye of the diver). Lenses 24*a* and 24*b* are substantially flat on the inner surface 26 of support plate 22 facing toward the diver's face, and are slightly convex on the outer surface 28 of support plate 22 facing away from the diver's face. As will be described in greater detail hereinbelow, the slight convexity of lenses 24*a* and 24*b* on outer surface 28 of support plate 22 is sufficient to compensate for the different indices of refraction between water and air such that marine light is transmitted therethrough without deviation.

Figure 4:
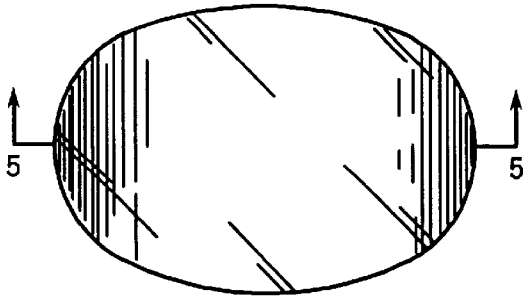
FIG. 4 is a front view of the lens of a second embodiment of the underwater diving mask of the present invention.
Figure 5:
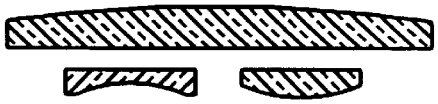
FIG. 5 is a cross-sectional view of the lens shown in FIG. 4, taken generally along line 5—5, shown with a pair of corrective lenses disassembled therefrom.

Referring to FIGS. 4 and 5, a lens 30 is provided for an underwater diving mask constructed according to a second embodiment of the present invention. Lens 30 is configured to be mounted within a single large opening formed in the forward part of a conventional face piece (such as opening 20 of face piece 12, as shown in FIG. 1) or in a diving helmet (not shown). It should be apparent that lens 30 is relatively large in size (as opposed to individual lenses 24*a* and 24 of the first embodiment) such that lens 30 completely closes the opening of the face piece or diving helmet. As best shown in FIG. 5, lens 30 has an inner surface 32 facing toward the diver's face that is substantially flat, and an outer surface 34 facing away from the diver's face is slightly convex. Again, as will be described in greater detail hereinbelow, the slight convexity of outer surface 34 of lens 30 is sufficient to compensate for the different indices of refraction between water and air such that marine light is transmitted therethrough without deviation.

Figure 6:
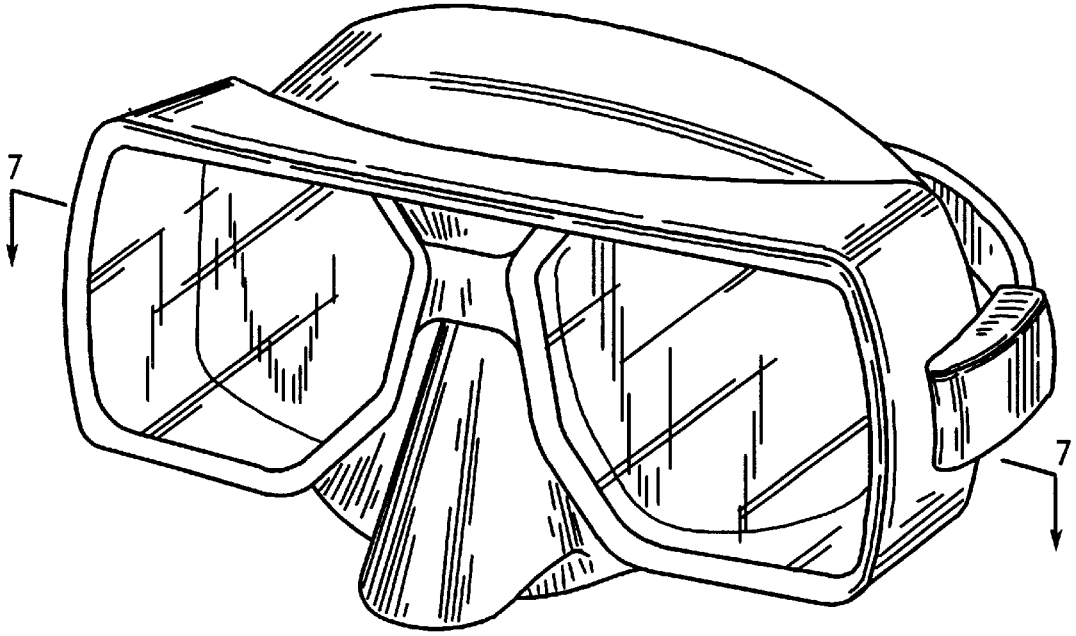
FIG. 6 is an isometric view of a third embodiment of the underwater diving mask of the present invention.
Figure 7:
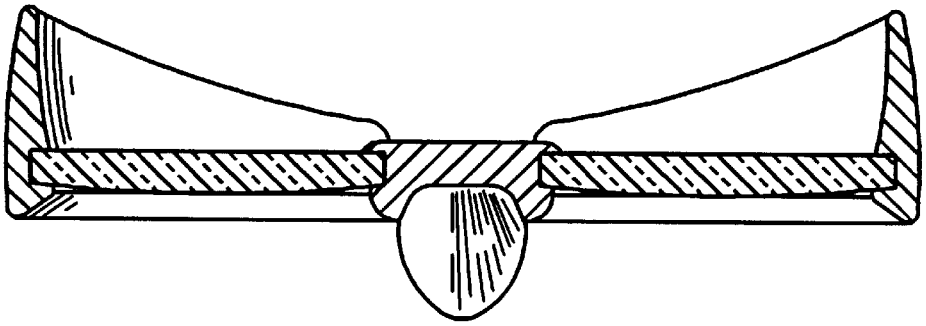
FIG. 7 is a cross-sectional view of the underwater diving mask shown in FIG. 6, taken generally along line 7—7.

Referring to FIGS. 6 and 7, an underwater diving mask 36 is constructed according to a third embodiment of the present invention. As shown in FIG. 6, mask 36 includes a conventional face piece 38 that is configured to fit over the eyes and nose of a diver, and a strap 40 for securing face piece 38 against the diver's face. Face piece 38 has two openings 42*a* and 42*b* formed in the forward part thereof, and two separate lenses 44*a* and 44*b* are mounted each respectively within a respective one of two openings 42*a* and 42*b* to provide closures therefor (i.e. a lens for each eye of the diver). It should be understood that openings 42*a* and 42*b* and lenses 44*a* and 44*b* could be formed of any shape that is suitable for use in or adaptation to a conventional diving mask. It should also be apparent to those skilled in the art that additional lateral openings and lenses could be utilized in accordance with the present invention.

Turning to FIG. 7, it can be seen that lenses 44*a* and 44*b* each have an inner surface 46*a* and 46*b* facing toward the diver's face that is substantially flat, and an outer surface 48*a* and 48*b* facing away from the diver's face that is slightly convex. Here again, the slight convexity of outer surfaces 48*a* and 48*b* of lenses 44*a* and 44*b* is sufficient to compensate for the different indices of refraction between water and air such that marine light is transmitted therethrough without deviation.

In all of the embodiments, lenses 24*a* and 24*b*, 30, and 44*a* and 44*b* can be formed of any transparent material that will enable the diver to view the surrounding marine environment. Preferably, the lenses are formed of optical quality material, such as optical quality polycarbonate (e.g. the polycarbonate obtainable from General Electric under the trademark LEXAN) or tempered glass (e.g. any tempered glass in conformance with the ANSI Z86:1985 standard).

As described and illustrated hereinabove, the inner surfaces of lenses 24*a* and 24*b*, 30, and 44*a* and 44*b* are substantially flat. These flat inner surfaces permit modification through tooling or the affixation of a secondary corrective lens for those divers who would otherwise require corrective lenses. For example, as shown in FIGS. 3 and 5, secondary lenses such as concave lens 50 could be affixed to the flat inner surface of the lens for near-sighted divers, while secondary lenses such as convex lens 52 could be affixed to the flat inner surface of the lens for far-sighted divers. Thus, those divers who require corrective lenses can also take advantage of the present invention.

As also described and illustrated hereinabove, the outer surfaces of lenses 24*a* and 24*b*, 30, and 44*a* and 44*b* are slightly convex. It should be understood that the lenses described in U.S. Pat. Nos. 5,359,371 and 5,523,804 to Nolan, the inventor of the present invention, are configured to have a slightly concave outer surface. It should be noted that, since issuance of these patents, the applicant has determined through experimental trial that structural convexity has the same compensating effect on marine light as structural concavity.

Preferably, the diopter value of the convex outer surface of the lens is between 0 and 1.0, and is most preferably between 0 and 0.5. These diopter values are sufficient to compensate for the magnification problem caused by the different indices of refraction between water and air, while remaining well out of range of the diopter values used for corrective vision. As such, the distortion of objects viewed out of the water (i.e. in air) is inconsequential. However, as described above, a secondary corrective lens can be affixed to the planar inner surface of the lens for those divers who would otherwise require corrective lenses.

It can be seen that the plano-convex lens of the present invention is structurally different from the flat support plate of conventional diving masks. In conventional diving masks, marine light intersects the flat support plate obliquely and is thereby refracted. By contrast, marine light intersects the convex outer surface of the lens normally and is transmitted therethrough without deviation. Consequently, the diver detects no distortions and accurately perceives the underwater environment. As a result, the visual field is unclouded by magnified distractions so that the diver can see further into the water column. In addition, the diver's peripheral visibility is more than double that of conventional diving masks.

The underwater diving mask of the present invention may also be treated to overcome other problems associated with conventional diving masks. For example, the plano-convex lenses of the present invention are preferably treated to reduce the likelihood of impaired underwater visibility attributable to lens fogging. Advex coatings from Miller Visual Dynamics of Clearfield, Utah, or HC/AF Glass Coating from V-TEC, Inc. of Chestnut Hill, Mass., or any other suitable anti-fogging means can be applied to the inner surfaces of the lenses to inhibit fogging, as is known in the art.

Also, the plano-convex lenses of the present invention are preferably designed to boost the amount of light transmitted through the lenses so as to provide a brighter visual field as compared to that of conventional diving masks. Thus, a suitable anti-reflective coating (such as Pentax AR Coating from Pentax Corporation of Englewood, Colo.) can be applied to the lens to boost the light transmission from 89% to 99.2%.

In addition, to reduce color distortion and/or provide protection from dangerous underwater radiation emissions, the plano-convex lenses of the present invention are preferably treated or coated with a coloring agent to inhibit the passage therethrough of certain wavelengths of light. One such agent the applicant has found to work well is a material available from Morton International of Lansing, Mich., referred as LS-123. Alternatively, the lenses may be formed with material that is already colored as desired. By introducing strategic color blocks within the 400 nm–580 nm spectral band (i.e. the blue-green range), significant improvements are achieved, not in color vision, but in contrast imaging which enables the naked eye to detect the presence of otherwise indiscernible objects from the natural background. In addition, non-ionizing lens blocks define a preventative health strategy for the congealment of critical ocular tissue. The plano-convex lenses of the present invention may also be polarized for the same purpose.

While the underwater diving mask of the present invention has been described and illustrated hereinabove with regard to specific embodiments, it should be understood that various design modifications could be made to these embodiments without departing from the scope of the present invention. For example, as described above, a plano-convex lens could be mounted in an opening formed in the forward part of a diving helmet. Also, a plano-convex replacement lens could be installed or retrofitted in an existing diving mask. Therefore, it can be seen that the present invention is not to be limited to these specific embodiments, except insofar as such limitations are included in the following claims.

I claim:

1. An underwater diving mask, comprising:

a face piece formed of suitable material so as to conform to the contour of a diver's face, said face piece having at least one opening formed in the forward part thereof;

means for releasably securing said face piece against the diver's face; and at least one lens of non-uniform thickness positioned within said opening of said face piece, said lens having a substantially planar inner surface facing toward the diver's face and a slightly convex outer surface facing away from the diver's face, wherein the slightly convex outer surface of the lens has a diopter value of between 0 and 1.0.

2. The underwater diving mask of claim 1 wherein said lens is mounted within said opening of said face piece so as to provide a closure therefor.

3. The underwater diving mask of claim 1 wherein said diving mask further comprises a transparent support plate mounted within said opening of said face piece so as to provide a closure therefor, wherein a pair of said lenses are integrally formed in a side-by-side relationship within said support plate.

4. The underwater diving mask of claim 1 wherein said face piece has two openings formed in a side-by-side relationship in the forward part thereof, and wherein two lenses are mounted within said openings so as to provide a closure therefor.

5. The underwater diving mask of claim 1 wherein said slightly convex outer surface of said lens has a diopter value of between 0 and 0.5.

6. The underwater diving mask of claim 1 further comprising at least one corrective lens bonded to said inner surface of said lens.

7. The underwater diving mask of claim 1 wherein said lens is formed of polycarbonate.

8. The underwater diving mask of claim 1 wherein said lens is formed of tempered glass.

9. An underwater diving mask comprising a face piece formed of suitable material so as to substantially conform to the contour of a diver's face and having at least one opening formed in the forward part thereof, means for releasably securing said face piece against the diver's face, and at least one lens of non-uniform thickness positioned within said opening of said face piece, said lens having a substantially planar inner surface facing toward the diver's face and a convex outer surface facing away from the diver's face with a diopter value of between 0 and 1.0.

10. The underwater diving mask of claim 9 further comprising at least one corrective lens bonded to said substantially planar inner surface of said lens.

11. A lens system installable into an underwater diving mask having at least one opening formed in the forward part thereof, said lens system comprising at least one lens of non-uniform thickness having a substantially planar inner surface that faces toward a diver's face when installed in the opening of the mask and a slightly convex outer surface that faces away from the diver's face when installed in the opening of the mask, wherein said slightly convex outer surface of said lens has a diopter value of between 0 and 1.0.

12. The lens system of claim 11 wherein said lens is configured to mount within the opening of the mask so as to provide a closure therefor.

13. The lens system of claim 11 further comprising a transparent support plate configured to mount within the opening of the mask so as to provide a closure therefor, wherein a pair of said lenses are integrally formed in a side-by-side relationship within said support plate.

14. The lens system of claim 11 wherein said slightly convex outer surface of said lens has a diopter value of between 0 and 0.5.

15. The lens system of claim 14 wherein said lens is formed of polycarbonate.

16. The lens system of claim 14 wherein said lens is formed of tempered glass.

17. An underwater diving mask configured to cover a diver's eyes, said mask having at least one opening formed in the forward part thereof and at least one lens positioned within said opening, said lens of a non-uniform thickness and having a substantially planar inner surface facing toward the diver's face and a slightly convex outer surface facing away from the diver's face, wherein said slightly convex outer surface of said lens has a diopter value of between 0 and 1.0.

18. The underwater diving mask of claim 17 wherein said slightly convex outer surface of said lens has a diopter value of between 0 and 0.5.

19. The underwater diving mask of claim 17 further comprising at least one corrective lens bonded to said inner surface of said lens.

20. The underwater diving mask of claim 17 further comprising means for inhibiting fogging of said inner surface of said lens.

21. The underwater diving mask of claim 17 further comprising means for inhibiting the passage of certain wavelengths of light through said lens.

22. The underwater diving mask of claim 17 wherein said lens is polarized.

23. The underwater diving mask of claim 17 further comprising an anti-reflectant coating applied to said lens.

* * * * *